US006380474B2

(12) United States Patent
Taruguchi et al.

(10) Patent No.: US 6,380,474 B2
(45) Date of Patent: Apr. 30, 2002

(54) METHOD AND APPARATUS FOR DETECTING PERFORMANCE POSITION OF REAL-TIME PERFORMANCE DATA

(75) Inventors: Hideaki Taruguchi; Masato Suzuki, both of Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/813,730

(22) Filed: Mar. 21, 2001

(30) Foreign Application Priority Data

Mar. 22, 2000 (JP) ..... 2000-079708

(51) Int. Cl.[7] ..... G10H 7/00
(52) U.S. Cl. ..... 84/612; 84/477 R
(58) Field of Search ..... 84/470 R, 477 R, 84/486, 645, 612, 636

(56) References Cited

U.S. PATENT DOCUMENTS 5,315,911 A * 5/1994 Ochi ..... 84/477 R
5,400,687 A * 3/1995 Ishii ..... 84/477 R
5,521,323 A * 5/1996 Paulson et al.
5,521,324 A * 5/1996 Dannenberg et al. ..... 84/612
5,756,918 A * 5/1998 Funaki
5,913,259 A * 6/1999 Grubb et al. ..... 84/612 X
5,952,597 A * 9/1999 Weinstock et al. ..... 84/477 R
6,084,168 A * 7/2000 Sitrick ..... 84/477 R
6,156,964 A * 12/2000 Sahai et al. ..... 84/470 R

* cited by examiner

*Primary Examiner*—Jeffrey Donels
(74) *Attorney, Agent, or Firm*—Morrison & Foerster

(57) ABSTRACT

Performance data is generated by performing in real time a music piece starting at a desired performance position. Performance position, in the music piece, of the real-time performance data is estimated from reference performance data of the music piece. Performance data to be performed following the estimated position is identified, and accuracy of the estimated position is determined in accordance with whether performance data corresponding to the identified performance data is generated as next real-time performance data. Because the accuracy of the estimated position is determined after generation of the next real-time performance data, a performance position following the estimated position determined as accurate represents a current performance position. Score based on the reference performance data is shown on a display, and the current performance position in the real-time performance is indicated on the displayed score. The indication of the current performance position on the display is moved in accordance with the identified tempo.

11 Claims, 4 Drawing Sheets

METHOD AND APPARATUS FOR DETECTING PERFORMANCE POSITION OF REAL-TIME PERFORMANCE DATA

BACKGROUND OF THE INVENTION

The present invention a method and apparatus for automatically detecting a performance position, on a musical score, of performance data input on a real-time basis, as well as a musical score display apparatus.

There have heretofore been proposed various musical score display apparatus for electronically displaying pictures of musical scores, which are commonly known as "electronic musical scores". Examples of such electronic musical scores include one which has a page-updating (page-turning) function for automatically detecting a position currently performed by a human player so as to display an appropriate one of pages of the musical score. However, because the conventionally-known electronic musical score is arranged to detect a changing performance position on the assumption that a performance is started at the very beginning of a music piece, that the performance does not stop on the way and that the human player makes no mistouch or misplay a musical instrument during the performance, it can not work properly when the music piece performance is started at some on-the-way point of the music piece, or, when a mistouch occurs, the electronic musical score tends to erroneously detect, or can not at all detect, the current performance position and thus would miss the proper page-turning timing.

SUMMARY OF THE INVENTION

In view of the foregoing, it is therefore an object of the present invention to provide a method and apparatus which can accurately detect a current performance position on a musical score during a real-time performance even when the performance is started at some on-the-way point of a music piece or when a player makes a mistouch. The present invention also seeks to provide a musical score display apparatus using such a method or apparatus of the invention.

In order to accomplish the above-mentioned objects, the present invention provides a performance position detection method which comprises: a reception step of receiving real-time performance data; a step of supplying reference performance data of a given music piece; an estimation step of estimating a performance position, in the music piece, of the real-time performance data, with reference to the reference performance data; a determination step of identifying performance data to be performed following the performance position estimated on the basis of the reference performance data, and determining accuracy of the estimated performance position in accordance with whether or not performance data corresponding to the identified performance data is actually received as next real-time performance data by the reception step.

Because the accuracy of the estimated performance position is determined in the present invention after generation of the next real-time performance data, a performance position following the estimated performance position determined as accurate represents a current performance position. Thus, once it is determined that the estimated performance position is accurate, a tempo of the real-time performance can be identified from a relationship between a time interval between two successive real-time performance data and corresponding note lengths of the reference performance data. The performance position detection method of the present invention may further comprise a management step of executing predictive management of timewise progression of the real-time performance in accordance with the tempo identified by the determination step, in which case the predictive management of timewise progression of the real-time performance by the management step is modified in accordance with the estimated performance position each time the estimated performance position is determined as accurate by the determination step. The predictive management of timewise progression of the real-time performance can be used, for example, to move a visual indicator indicating the current performance position on the musical score shown on the display device, or to cause impartment of a predetermined effect or other predetermined tone control to be automatically executed when the current performance position has arrived at a predetermined position on the musical score.

Namely, as an example, the performance position detection method of the present invention may further comprise: a step of showing, on a display device, a musical score based on the reference performance data; a step of providing a visual indicator to indicate, as a current performance position, a performance position following the estimated performance position determined as accurate by the determination step, on the musical score shown on the display device; and a step of controlling, in accordance with the tempo identified by the determination step, movement of the visual indicator on the musical score shown on the display device. Position of the visual indicator may be modified in accordance with the estimated performance position each time the estimated performance position is determined as accurate by the determination step.

The real-time performance data may be in the form of performance information including note data such as MIDI data. Alternatively, the real-time performance data may be analog or digital audio data generated by live performance of a musical instrument. The performance data received in real time via a microphone or input interface is analyzed to detect a tone pitch of the received performance data.

The present invention may be constructed and implemented not only as the method invention as discussed above but also as an apparatus invention. Also, the present invention may be arranged and implemented as a software program for execution by a processor such as a computer or DSP, as well as a storage medium storing such a program. Further, the processor used in the present invention may comprise a dedicated processor with dedicated logic built in hardware, rather than a computer or other general-purpose type processor capable of running a desired software program.

While the embodiments to be described herein represent the preferred form of the present invention, it is to be understood that various modifications will occur to those skilled in the art without departing from the spirit of the invention. The scope of the present invention is therefore to be determined solely by the appended claims.

BRIEF DESCRIPTION OF THE DRAWINGS

For better understanding of the object and other features of the present invention, its embodiments will be described in greater detail hereinbelow with reference to the accompanying drawings, in which.

DETAILED DESCRIPTION OF EMBODIMENTS

Figure 1:
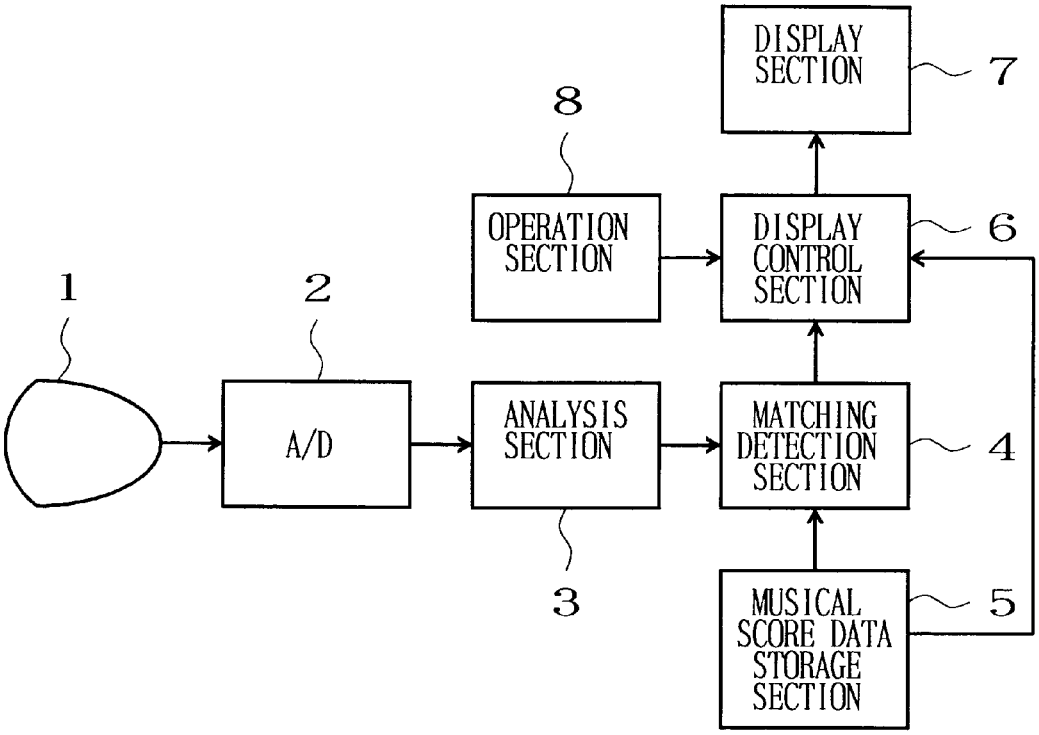
FIG. 1 is a block diagram showing a general setup of a musical score display apparatus in accordance with an embodiment of the present invention.

First, one embodiment practicing the basis principles of the present invention is outlined as follows. The embodiment is characterized by executing: a tone pitch data input process for receiving tone pitch data of a real-time performance; a note trace process for estimating a performance position, of the received tone pitch data, in a note data train representative of notes of a given music piece; and a time scale process for identifying, on the basis of the estimated performance position, tone pitch data to be next received, determining accuracy of the estimated performance position on the basis of next received tone pitch data, and then identifying a tempo of the performance when the estimated performance position is determined as accurate.

Another embodiment practicing the basis principles of the present invention is outlined as follows. Namely, this embodiment is characterized by comprising: a memory storing musical score data including a note data train representative of notes of a given music piece; a display device for displaying the musical score data read out from the memory; an input device for receiving tone pitch data of a real-time performance; and a control device that estimates a performance position, of the received tone pitch data, in the note data train, identifies, on the basis of the estimated performance position, tone pitch data to be next received, determine accuracy of the estimated performance position on the basis of next received tone pitch data, identifies a tempo of the performance when the estimated performance position is determined as accurate, and controls the display device on the basis of the thus-identified performance position and tempo.

The above-mentioned note data train comprises a plurality of note data, each of which includes at least tone pitch information indicative of a pitch of the note and tone length information indicative of a length or duration of the note. The tone pitch information may be expressed in the "note name plus octave number" notation, such as C3 or D3, or in the halfstep notation where C1=0, C2=12 and C3=24. The tone pitch data of the real-time performance may be expressed in the same notation as the tone pitch information of the note data in the note data train, so that the input or received tone pitch data and tone pitch information of the note data can be compared for determination of a match (i.e., coincidence)/mismatch (i.e., non-coincidence) therebetween. Further, the tone pitch data of the real-time performance may be input directly from a MIDI instrument or the like. Alternatively, a performed tone or human voice may be input via a microphone, and tone pitch data may be extracted from the input sound signal. Further, the tone pitch data may be obtained by reproductively reading out performance data recorded in memory; in this case, the read-out performance data is also referred to as "real-time performance data".

In the present invention, the note trace process is performed for detecting a position in the note data train which matches the real-time input tone pitch data. Although a plurality of such tone pitch data are input through a real-time performance, all of the tone pitch data need not necessarily match any one of the notes in the note data train, and a position of a note in the note data train matching relatively many of the input tone pitch data is selected as a candidate of the performance position (estimated performance position); that is, a position of a note in the note data train which corresponds in pitch to relatively many of the input tone pitch data, i.e. which has a relatively high ratio of matching with the input tone pitch data, is set as a candidate of the performance position. By thus searching through the entire note data train, it is possible to appropriately detect a current performance position irrespective of a position which the performance is started at and despite any possible mistouch during the performance.

Then, the time scale process is performed on one candidate having a highest matching ratio, or a plurality of candidates having relatively high matching ratios. The time scale process awaits input of next tone pitch data that will correspond to the tone pitch information of the note data to be next performed at the performance positions selected as the candidate, and ultimately judges one of the candidate positions matching the input tone pitch data to be an accurate current performance position. If only one candidate has been judged as the accurate current performance position, the accuracy of the candidate is determined. If a plurality of candidates have been judged as the accurate current performance position, then a determination is made which of these candidates is accurate. Then, as long as an accurate candidate exists, a tempo of the performance is identified on the basis of the input timing of the tone pitch data. Because the note data includes the tone length information as well, the performance tempo can be identified by comparing the tone length information and the input timing.

Further, the current performance position can be identified accurately through a combined use of the above-mentioned search (note trace) process performed in the tone-pitch-data to note-data direction for searching through the note data train on the basis of input pitch data and the time scale process performed in the note-data to tone-pitch-data direction for awaiting pitch data to be input next at the candidate performance positions.

Now, the embodiments of the present invention will be described more fully with reference to the accompanying drawings.

Figure 2:
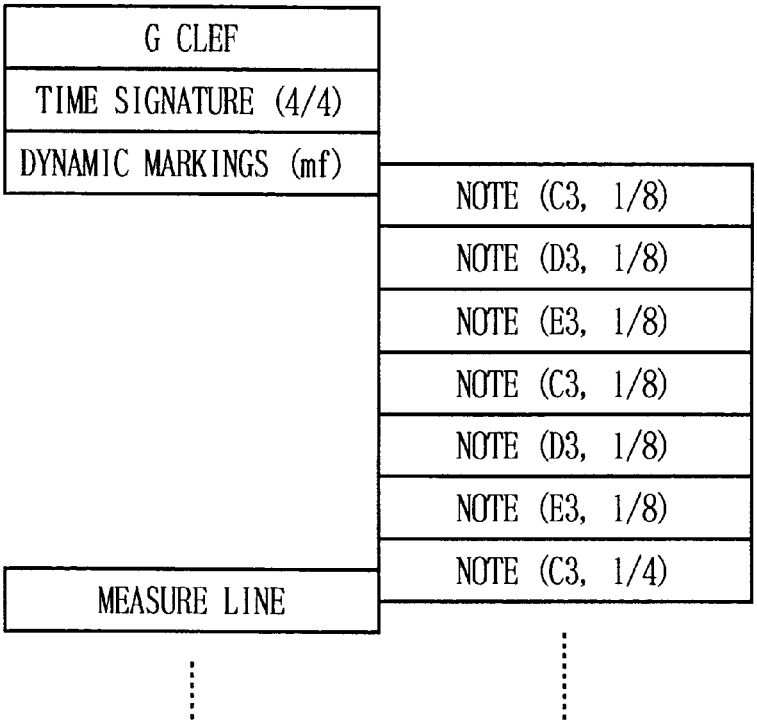
FIG. 2 is a diagram showing an exemplary format of musical score data stored in the musical score display apparatus of FIG. 1.

FIG. 1 is a block diagram showing a general setup of a musical score display apparatus in accordance with an embodiment of the present invention, and FIG. 2 is a diagram showing an exemplary format of musical score data stored in the musical score display apparatus. In a musical score data storage section 5, there are stored musical score data to be visually shown on a display section 7. Tones generated from a performance of a music piece depicted on the musical score are input into a microphone 1. The input tones may be tones performed by a natural (acoustic) or electronic musical instrument or singing voices of a human. Further, the input tones may be tones performed on the spot or in real time, or tones reproduced from a compact disk (DC). Each of the tones input via the microphone 1 is converted via an A/D converter 2 into a digital signal that is then passed to an analysis section 3. The analysis section 3 divides each of the input tone signal into short frames and extracts tone pitch data of the tone signal on a frame-by-frame basis. The tone pitch data is data indicating which of pitches of a 12-tone scale the input tone signal falls at. The tone pitch data may be expressed in the "pitch name plus octave" notation, such as C3 or D4, or by one of numerical values representative of all pitches within a predetermined range to be processed by the apparatus. In determining the pitch, the input tone signal with a slight frequency deviation is associated with or converged to the nearest one of the scale note pitches. Namely, even when the pitch of the input tone signal deviates from any of the normal scale note pitches, one of the scale note pitches closest to the pitch of the input tone signal is extracted as tone pitch data of the input tone signal.

The extracted tone pitch data is given to a matching detection section 4, to which are input, along with the tone pitch data, musical score data of a music piece containing the tone. The musical score data are not only for visually displaying a picture of the musical score but also for indicating pitches of individual notes presented on the score. As shown in FIG. 2, in the storage section 5, there are stored note data indicative of respective pitches and lengths of the individual notes and symbol data indicative of various other symbols than the notes, along with display position information indicating where these notes and other symbols are to be displayed. Each of the display position information is expressed on a time axis with its unit of time set to equal a tempo clock. Vertical display position of each the note data is decided in accordance with the tone pitch, while a vertical display position of each of the symbol data is decided in accordance with a particular type of the symbol. The musical score data includes a plurality of pages.

The matching detection section 4 compares the analyzed tone pitch data of the input tone signal and the corresponding note data in the musical score data, so as to detect a matching or coinciding point between the two compared data. The matching detection section 4 supplies a display control section 6 with the thus-detected matching point as current point data.

The display control section 6 reads out a predetermined page of the musical score data from the musical score data storage section 5, and then develops the read-out musical score data into musical score picture data to be visually shown on a display section 7. Which page of the musical score data is to be read out is decided on the basis of the current point data and operation information given by an operation section 8. Further, the picture of the musical score is controlled to highlight a position being currently performed, i.e., current performance position. In the instant embodiment, the current performance position is identified on the basis of the above-mentioned current point data and tempo data input simultaneously with the current point data. The highlighted indication may be made such as by indicating the staves (on which the music is written) in thick or heavy lines, indicating the currently-performed note in an enlarged size or changing a display color of the currently-performed note. Note that the musical score may be displayed in any other form than the conventional staff form.

The operation section 8 includes a page-turning operator for manually changing the page of the musical score to be shown on the display section 7, and an operator for specifying a page to be displayed at the start of the music piece performance.

Specifically, the matching detection section 4 operates as follows. The matching detection section 4 detects a current performance position on the musical score data, on the basis of the input tone pitch data and performance tempo. The detection of the current performance position is carried out in two directions in the instant embodiment; that is, the instant embodiment carries out the note trace process in the tone-pitch-data (performance) to note-data (musical score) direction for searching through the note data train on the basis of input tone pitch data so as to find matching points (candidates of the current performance position,) and the time scale process performed in the note-data (musical score) to tone-pitch-data (performance) direction for identifying note data likely to be performed next and then awaiting input of tone pitch data corresponding to the identified note data.

Figure 3:
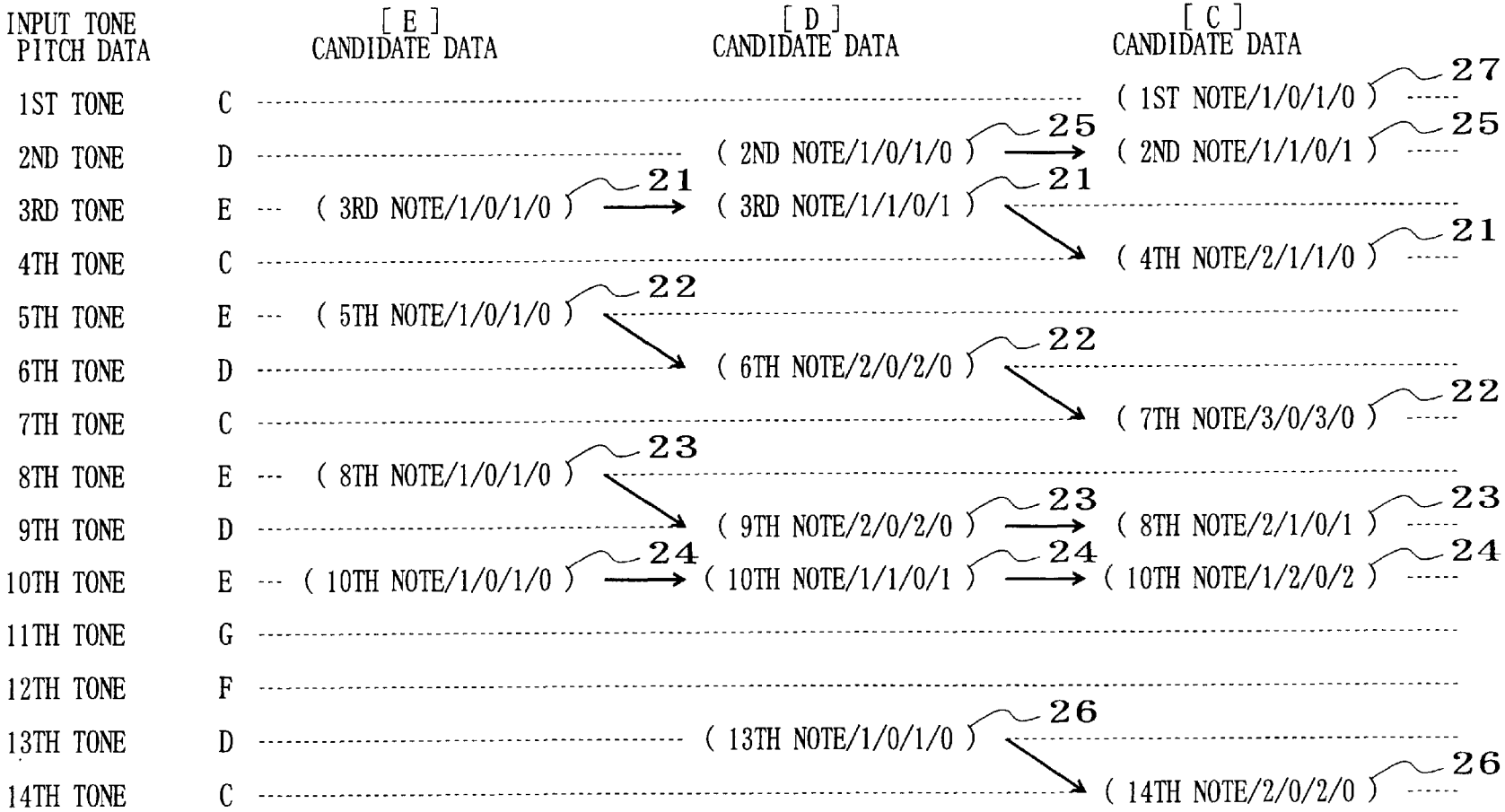
FIG. 3 is a diagram explanatory of a note trace process carried out in the musical score display apparatus.

The note trace process is designed to generate a tone pitch train on the basis of successively-input tone pitch data and detect matches between the input tone pitch train and the note data train in the musical score data; that is, the note trace process extracts, from the musical score data, a partial tone pitch arrangement pattern that coincides with or matches with an arrangement pattern of the input tone pitch train. Details of the note trace process will be described with reference to FIG. 3, assuming that the note data train in the musical score data is arranged as "C, D, E, C, E, D, C", "E, D, E, G, F, D, C" in the mentioned order. FIG. 3 shows a case where the performance of the note data train was started with the fifth note "E" and then carried out up to the last note "C" with no mistouch, i.e. where the notes "E, D, C, . . . , C" were performed appropriately with no mistouch. The instant embodiment is arranged to be able to detect the current performance position even when a music piece performance is re-started at some on-the-way point of the music piece such as in practicing the performance.

First, "E" is input as the first tone pitch data, and the musical score data are searched for note data that match with the tone pitch data "E". As a result, the third, fifth, eighth and tenth notes in the note data train are identified as matching with the input tone pitch data "E". Then, the positions of these third, fifth, eighth and tenth notes are stored in memory as candidates 21, 22, 23 and 24, respectively, of the current performance position. When next input tone pitch data match the note data (the fourth, sixth, ninth and eleventh notes), these candidates are moved to the positions of the next matching note data.

Candidate data, informative of each of the current performance position candidates, comprises data indicative of "note position/number of matches/number of mismatches/number of successive matches/number of successive mismathces", and this candidate data is updated each time new tone pitch data is input to the musical score display apparatus. Here, the "note position" indicates which of the note data positions the current performance position candidate represents. The "number of matches" represents the number of input tone pitch data having been detected as matching with the note data in the note data train, while the "number of mismatches" represents the number of input tone pitch data having been detected as failing to match with the note data in the note data train. Further, the "number of successive matches" indicates how many of the input tone pitch data have been detected as matching with the note data in succession, while the "number of successive mismatches" indicates how many of the input tone pitch data have been detected as failing to match with the note data in succession.

Because the candidates 21 ro 24 each represent a match with only the first input tone pitch data, the candidate data of these candidates 21 ro 24 are provided as "3rd note/1/0/1/0", "5th note/1/0/1/0", "8th note/1/0/1/0" and "10th/1/0/1/0", respectively.

Then, "D" is input as the next tone pitch data, and it is ascertained, for each of the current performance position candidates 21 to 24, whether the following note data is "D" or not. Because the note data following the candidates 22 and 23 are each "D", the note positions of these candidates 22 and 23 are moved to the position of the following note data so that the candidate data are updated accordingly. Namely, the candidate data of the candidate 22 is updated to "6th note/2/0/2/0", and the candidate data of the candidate 23 is updated to "9th note/2/0/2/0". On the other hand, the current performance position candidates 21 and 24 are judged to be non-matching with the input tone pitch data because the note data following these candidates 21 and 24 are not "D", so that the candidate data of the candidate 21 becomes "3rd note/1/1/0/1" while the candidate data of the candidate 24 becomes "10th note/1/1/0/1".

Then, a search is made for note data "D" to which none of the existing current performance position candidates has been moved, as a result of which the second and thirteenth notes in the musical score data are detected as such note data. The positions of the thus-detected second and thirteenth notes are set as new candidates 25 and 26 of the current performance position. Candidate data of the candidate 25 is provided as "2nd note/1/0/1/0" while candidate data of the candidate 26 is provided as "13th note/1/0/1/0".

Then, "C" is input as still next tone pitch data, and it is ascertained, for each of the current performance position candidates 21 to 26, whether the note data following the candidate is "C" or not. Because the note data following the candidates 21, 22 and 26 are each "C", the note positions of these candidates 21, 22 and 26 are moved to the position of the following note data so that the candidate data are updated accordingly. Namely, the candidate data of the candidate 21 is updated to "4th note/2/1/1/0", the candidate data of the candidate 22 is updated to "7th note/3/0/3/0", and the candidate data of the candidate 26 is updated to "14th note/2/0/2/0". On the other hand, the current performance position candidates 23 to 25 are judged to be non-matching with the input tone pitch data, so that the candidate data of the candidate 23 becomes "9th note/2/1/0/1", the candidate data of the candidate 24 becomes "10th note/1/2/0/2", and the candidate data of the candidate 25 becomes "2nd note/1/1/0/1". Then, a search is made for note data "C" to which none of the existing current performance position candidates has been moved, as a result of which the first note in the musical score data is detected as such note data. The position of the thus-detected first note is set as a new candidate 27 of the new current performance position, and candidate data of the candidate 27 is provided as "1st note/1/0/1/0".

Namely, in the candidate data of the current performance position candidate 22, indicating the accurate current performance position (accurate current point), the number of matches and the number of successive matches both take great values, but the number of mismatches takes a small value (0). Thus, the accurate current point can be identified by examining the candidate data of the individual current performance position candidates. The reason why the candidate non-matching with the input tone pitch data is left over with the numbers of mismatches stored in memory, rather than being instantly deleted, is to deal with a situation where the human player inputs a wrong tone by mistouch. Namely, if the player makes a mistouch, the number of mismatches in the candidate data increases only by one, and this will never present a great obstacle to identification of the accurate current point. For example, even when "E, D, C, . . . " are erroneously performed as "E, D, D, C, . . . ", the candidate data of the candidate 22 becomes "7th note/3/1/2/0", which can still remain as a promising candidate of the current point. Further, when the player performs a wrong tone or skips a certain tone, the operation for identifying the accurate current performance position candidate shown in FIG. 3 is started with a tone immediately following the wrong or skipped tone.

Now, the time scale process employed in the instant embodiment is described. The candidates of the current performance position or current point can be narrowed down to a few promising candidates through the above-described note scale trace process. Then, one note data is extracted from the neighborhood of each of the narrowed-down candidates, and the display apparatus waits and see whether tone pitch data matching with the extracted note data arrives at or around a predetermined time point. Then, which of the candidates represents the actual current point is determined on the basis of the tone pitch data having arrived at and around the predetermined time point. Also, the performance tempo is extracted on the basis of the actual arrival time of the tone pitch data matching with the extracted note data, so that a visual indicator indicating the current point on the displayed musical score is advanced predictively in accordance with the thus-extracted tempo.

Figure 4:
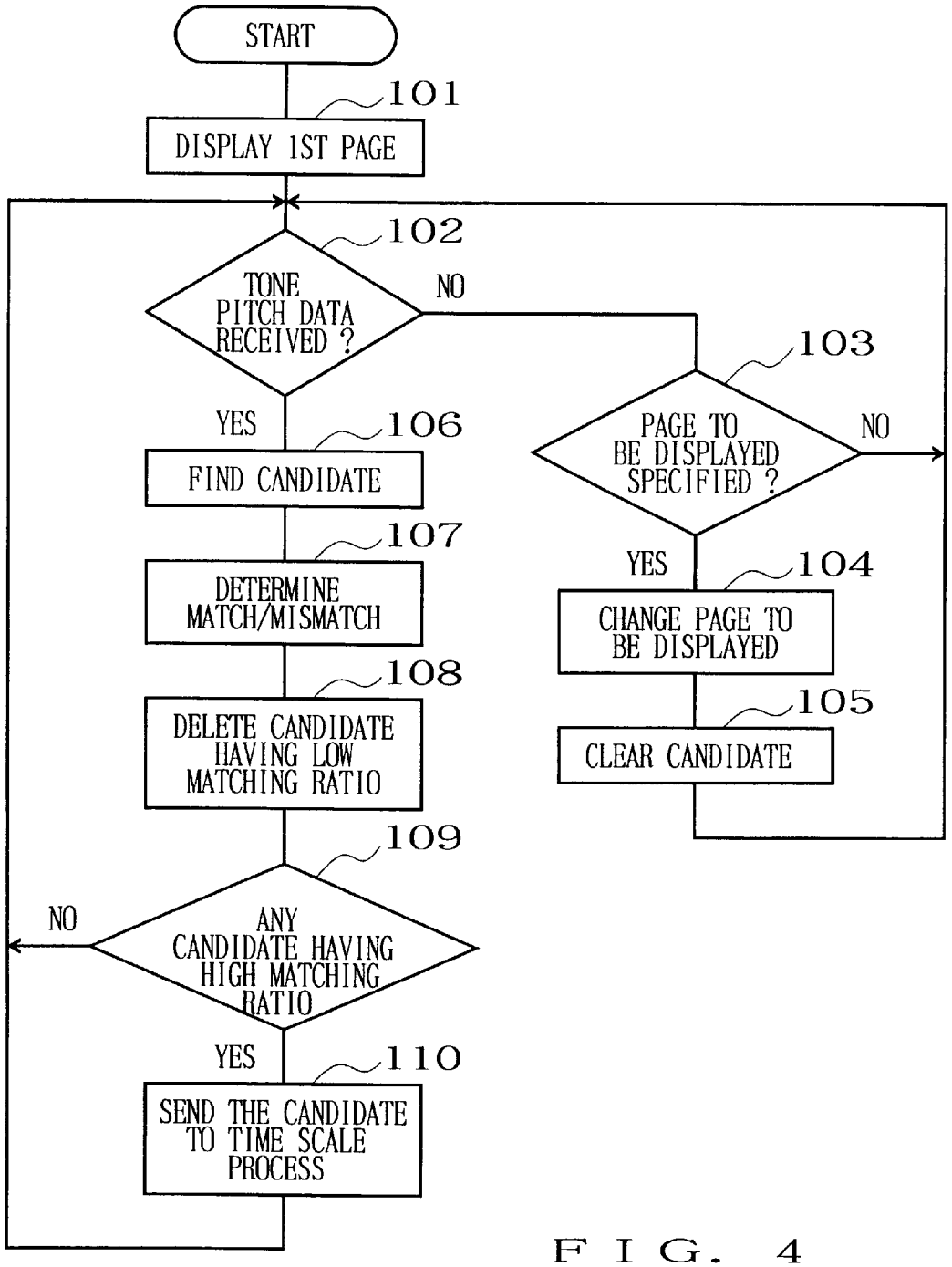
FIG. 4 is a flow chart showing the above-mentioned note trace process.
Figure 5:
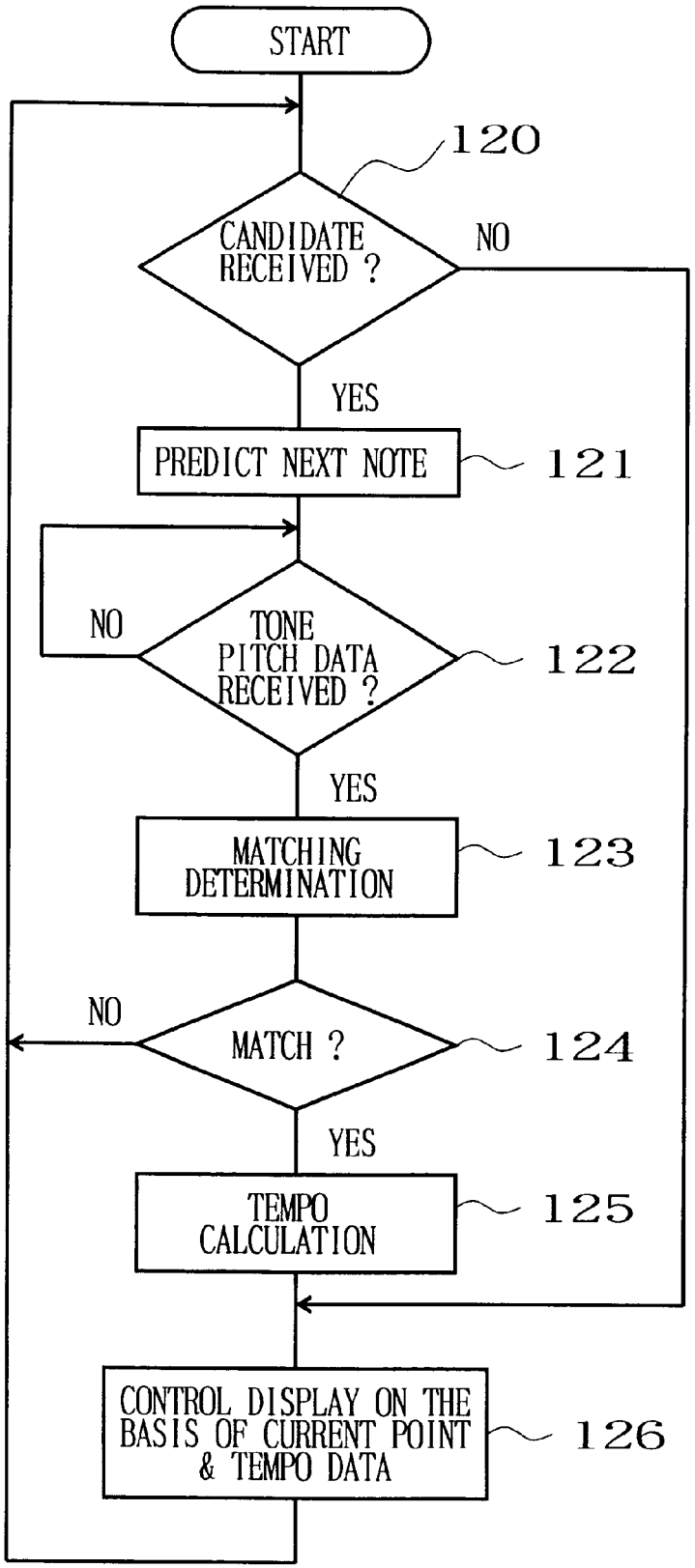
FIG. 5 is a flow chart showing an example of a time scale process carried out in the musical score display apparatus.

FIGS. 4 and 5 are flow charts explanatory of behavior the musical score display apparatus in accordance with the embodiment. More specifically, FIG. 4 is a flow chart showing the above-mentioned note trace process. First, at step 101, the display control section 6 reads out the first page of the musical score data from the musical score data storage section 5, and displays the read-out first page on the display section 7. Then, a determination is made at step 102 whether any tone pitch data has been input or not, and if answered in the negative at step 102, it is further determined whether or not an instruction for changing the displayed page to the next page has been input via the operation section 8. If the page changing instruction has been input as determined at step 103, then the display control section 6, at step 104, reads out the next page of the musical score data from the musical score data storage section 5, and displays the read-out next page on the display section 7. If any current point candidate is stored in memory, such a candidate is cleared or erased at step 105.

If tone pitch data has been input as determined at step 102, the note data train in the musical score data is searched, at step 106, using the input tone pitch data, so as to find current point candidates. This search operation corresponds to the operation shown and described above in relation to FIG. 3, which also includes updating of each already-set candidate. Then, degree of matching of the currently-set individual candidates with the input tone pitch data is determined at step 107. The matching degree is determined on the basis of a note matching ratio, number of successive matches, number of successive mismatches, etc.; the note matching ratio in this case is calculated by dividing the "number of matches" by the "sum of the number of matches and number of mismatches". The note matching ratio is calculated at step 107 for each of the current point candidates. At next step 108, each candidate, for which the calculated note matching ratio is lower than a predetermined first reference value m1 and the number of successive mismatches is greater than a predetermined second reference value m2, is judged to have a very low chance of being the accurate current point and thus removed from the list of the candidates, and also the candidate data of the removed candidate is deleted from memory. Further, a determination is made as to whether there is any candidate having a high chance of being the accurate current point, for which the number of matches is greater than a predetermined third reference value m3 and the note matching ratio is higher than a predetermined fourth reference value m4. If answered in the affirmative at step 109, then this high-chance candidate is transmitted to the time scale process at step 110. As the above-mentioned first to fourth reference values m1 to m4, proper values are chosen such that no appropriate candidate of the current point fails to be selected and any candidate with no chance at all of being the accurate current point is reliably prevented from being selected.

Further, FIG. 5 is a flow chart showing an example of the time scale process carried out in the instant embodiment. The time scale process waits, at step 120, until the current point candidate is sent from the above-described note trace process. Once such a candidate is received from the note trace process, tone pitch data which will be next sent is predicted on the basis of the received current point candidate and the note data train of the musical score data, at step 121. Then, the time scale process waits, at step 122, until next tone pitch data is input to the musical score display apparatus. Upon receipt of the next tone pitch data, it is determined at step 123 whether or not the received or input tone pitch data and the predicted tone pitch data match with each other. If answered in the affirmative at step 124, a performance position, on the musical score, of the predicted tone pitch data is judged to be the current point, so that updating of a highlighted displayed position and page of the musical score data is controlled assuming that the performance will progress at a tempo calculated on the basis of the current performance position (current point data), at step 126. Such display control based on such data is continued until a new current point candidate is input to the musical score display apparatus and a new current point and performance tempo are determined. If the input tone pitch data and the predicted tone pitch data do not match with each other as determined at step 123, the candidate sent from the note trace process is abandoned as inappropriate, and the time scale process reverts to step 120. For example, step 110 of the note trace process of FIG. 4 sequentially transmits the candidates to the time scale process of FIG. 5 in descending order of their chances of being the accurate current point or performance position. Thus, when the time scale process reverts to step 120, the candidate having the second highest chance is received by the process.

In the above-described musical score display apparatus of the invention, there are provided the microphone 1, A/D converter 2 and analysis section 3, and tone pitch data is extracted from an analog tone signal produced via a live performance. However, the present invention is not so limited; for example, there may be provided an input terminal, such as a MIDI terminal, so that tone pitch data produced from another electronic musical instrument, keyboard or the like can be input directly to the musical score display apparatus via the input terminal.

Further, although the embodiment has been described above in relation to the musical score display apparatus, the present invention should not be construed as limited to such a musical score display apparatus. For example, the present invention may be applied to an effect impartment apparatus for imparting an effect to a performed tone, in which case an apparatus for automatically changing effect settings in response to detection of a predetermined performance position can be provided by identifying a changing performance position in accordance with the principles of the present invention.

According to the present invention arranged to search through an entire note data train in the above-described manner, it is possible to appropriately detect a current performance position irrespective of a position at which a performance is started and despite any mistouch during the performance. Further, the present invention can identify the current performance position accurately through a combined use of the search (note trace) process performed in the tone-pitch-data (performance) to note-data (musical score) direction for searching through a note data train on the basis of input tone pitch data to thereby identify a current performance position candidate and the time scale process performed in the note-data to tone-pitch-data direction for awaiting pitch data to be input at the position of the current point candidate.

What is claimed is:

1. A performance position detection method comprising:

a reception step of receiving real-time performance data;

a step of supplying reference performance data of a given music piece;

an estimation step of estimating a performance position, in the music piece, of the real-time performance data, with reference to the reference performance data;

a determination step of identifying performance data to be performed following the performance position estimated on the basis of the reference performance data, and determining accuracy of the estimated performance position in accordance with whether or not performance data corresponding to the identified performance data is actually received as next real-time performance data by said reception step;

a step of identifying a tempo of performance based on the real-time performance data when the estimated performance position is determined as accurate by said determination step; and a management step of executing predictive management of timewise progression of the real-time performance in accordance with the tempo identified by said determination step, wherein the predictive management of timewise progression of the real-time performance by said management step is modified in accordance with the estimated performance position each time the estimated performance position is determined as accurate by said determination step.

2. A performance position detection method as claimed in claim 1, wherein said estimation step includes a step of extracting one or more candidates estimated to be possible current performance position on the basis of a plurality of real-time performance data received in a time-serial fashion, and wherein said determination step determines the accuracy of the estimated performance position in descending order of changes of the extracted candidates being a current performance position.

3. A performance position detection method as claimed in claim 1, wherein the real-time performance data received by said reception step includes note data, and the reference performance data include a note train of the given music piece, and wherein said estimation step estimates which position of the note data train included in the reference performance data the note data of the received real-time performance data corresponds to.

4. A performance position detection method as claimed in claim 1, wherein said reception step includes a step of detecting a tone pitch of the received real-time performance data.

5. A performance position detection method as claimed in claim 1, further comprising the steps of:

a step of visually showing, on a display device, a musical score based on the reference performance data; and a step of providing a visual indicator to indicate, as a current performance position, a performance position following the estimated performance position determined as accurate by said determination step, on the musical score shown on said display device.

6. A performance position detection method as claimed in claim 1, further comprising the step of:

a step of showing, on a display device, a musical score based on the reference performance data;

a step of providing a visual indicator to indicate, as a current performance position, a performance position following the estimated performance position determined as accurate by said determination step, on the musical score shown on said display device, and a step of controlling, in accordance with the tempo identified by said determination step, movement of the visual indicator on the musical score shown on said display device, a position of the visual indicator being modified in accordance with the estimated performance position each time the estimated performance position is determined as accurate by said determination step.

7. A machine-readable storage medium containing a group of instructions to cause said machine to implement a method for detecting a performance position of real-time performance data, said method comprising the steps of:

a reception step of receiving real-time performance data;

a step of supplying reference performance data of a given music piece;

an estimation step of estimating a performance position, in the music piece, of the real-time performance data, with reference to the reference performance data;

a determination step of identifying performance data to be performed following the performance position estimated on the basis of the reference performance data, and determining accuracy of the estimated performance position in accordance with whether or not performance data corresponding to the identified performance data is actually received as next real-time performance data by said reception step;

a step of identifying a tempo of performance based on the real-time performance data when the estimated performance position is determined as accurate by said determination step; and a management step of executing predictive management of timewise progression of the real-time performance in accordance with the tempo identified by said determination step, wherein the predictive management of timewise progression of the real-time performance by said management step of modified in accordance with the estimated performance position each time the estimated performance position is determined as accurate by said determination step.

8. A machine-readable storage medium as claimed in claim 7, where said method further comprises:

a step of showing, on a display device, a musical score based on the reference performance data;

a step of providing a visual indicator to indicate, as a current performance position, a performance position following the estimated performance position determined as accurate by said determination step, on the musical score shown on said display device; and a step of controlling, in accordance with the tempo identified by said determination step, movement of the visual indicator on the musical score shown on said display device, a position of the visual indicator being modified in accordance with the estimated performance position each time the estimated performance position is determined as accurate by said determination step.

9. An apparatus for processing performance data comprising:

an input device adapted to receive real-time performance data;

a storage device storing reference performance data of a given music piece; and a processor device coupled with said input device and said storage device and adapted to:

estimate a performance position, in the music piece, of the real-time performance data received by said input device, with reference to the reference performance data stored in said storage device;

identify performance data to be performed following the performance position estimated on the basis of the reference performance data, and determine accuracy of the estimated performance position in accordance with whether or not performance data corresponding to the identified performance data is actually received as next real-time performance;

identify a tempo of performance based on the real-time performance data when the estimated performance position is determined as accurate; and execute predictive management of timewise progression of the real-time performance in accordance with the identified tempo, wherein the predictive management of the timewise progression of the real-time performance is modified in accordance with the estimated performance position each time the estimated performance position is determined as accurate.

10. An apparatus as claimed in claim 9, further comprising a display device operatively coupled with said processor device, wherein said processor device is further adapted to visually show, on said display device, a musical score based on the reference performance data, and provide a visual indicator to indicate, as a current performance position, a performance position following the estimated performance position determined as accurate, on the musical score shown on said display device.

11. An apparatus as claimed in claim 10 wherein said processor device is further adapted to:

identify a tempo of performance based on the real-time performance data when the estimated performance position is determined as accurate; and control, in accordance with the identified tempo, movement of the visual indicator on the musical score shown on said display device, a position of the visual indicator being modified in accordance with the estimated performance position each time the estimated performance position is determined as accurate.

* * * * *